United States Patent [19]

Patterson

[11] 4,084,015

[45] Apr. 11, 1978

[54] CAGE ORNAMENT AND CARD

[76] Inventor: Michael P. Patterson, 1425 Maricopa Dr., Oshkosh, Wis. 54901

[21] Appl. No.: 685,818

[22] Filed: May 12, 1976

[51] Int. Cl.[2] ..... B65D 5/02; G09F 1/06

[52] U.S. Cl. ..... 428/9; 35/72; 40/539; 40/617; 46/1 L; 229/8; 229/92.8; 428/43; 428/542

[58] Field of Search ..... 40/124.1, 126 A, 128; 35/72; 229/8, 92.8; 46/1 L, 31, 35–37; 119/23; 428/7–9, 11, 542; D48/20 B, 16 R, 16 A, 16 B, 16 C, 16 D; D30/3, 4

[56] References Cited

U.S. PATENT DOCUMENTS

| | | | |
|---|---|---|---|
| D. 164,323 | 8/1951 | Robins | D11/129 X |
| 241,409 | 5/1881 | Osborn | 229/39 R |
| 550,247 | 11/1895 | Buch | 229/39 R |
| 1,393,213 | 10/1921 | Gilbert | 428/43 X |
| 1,861,206 | 5/1932 | Burgess | 229/8 X |
| 2,616,199 | 11/1952 | Robins | 428/9 |
| 2,974,434 | 3/1961 | Gibson | 40/124.1 |
| 3,010,246 | 11/1961 | England | 428/542 X |
| 3,134,708 | 5/1964 | Lohnes | 428/542 X |
| 3,440,747 | 4/1969 | Oliver | 40/126 A |
| 3,886,815 | 2/1975 | Desmond | 46/35 X |

*Primary Examiner*—George F. Lesmes
*Assistant Examiner*—Henry F. Epstein
*Attorney, Agent, or Firm*—Dugger, Johnson & Westman

[57] ABSTRACT

A greeting card which includes an ornament that can be folded into a three-dimensional bird cage, with small paper board birds that protrude partly from the sides, and which card can include a separate panel for containing a greeting that may be separated from the other panels in which the bird cage is contained as a punch out ornament. The combination provides an attractive three-dimensional ornament that can be used for hanging in appropriate places, as well as a remembrance type card.

3 Claims, 4 Drawing Figures

CAGE ORNAMENT AND CARD

BACKGROUND OF THE INVENTION

1. Field of the Invention

The present invention relates to a greeting card that includes a three-dimensional fold out ornament of unique design.

2. Prior Art

Reference is made to my co-pending U.S. Pat. application Nos. 685,820 for Greeting Card and Ornament and 685,817 for Star Ornament and Card, both filed on even date herewith, with prior art copies submitted in these applications showing various designs and ornaments.

For example, U.S. Pat. No. 2,616,199 shows an ornament that is formed into a card, and Design patent U.S. Pat. No. Des. 164,323 also shows a decorative greeting card that can be made into an ornament. A self-forming toy device or ornament is shown in U.S. Pat. No. 3,010,246. It is believed that the other patents cited in the applicant's companion applications are not as pertinent to the teaching in this particular application, but reference to such prior art is incorporated herein.

SUMMARY OF THE INVENTION

The present invention relates to a combination greeting card with a unique folding ornament therein. The greeting card is a three panel card, with the front panel being detachable along a perforated line for retention as a remembrance, while the second and third panels, which fold relative to each other and also fold behind the front panel carry a punch out three dimensional cage ornament. The ornament simulates a bird cage with small birds that can be partially punched out and twisted so that they will protrude from the sides of the cage. The cage itself is folded in a unique manner to form a rectangular cross section midportion, having pyramidal upper and lower ends, locked together with tabs. The birds themselves are defined by punched out portions that can be removed from the paper stock and then the birds twisted once the cage is assembled out of the plane of the wall from which the bird is formed to comprise the unique decorative hanging ornament.

The ornament is simple to erect and use, and forms a unique remembrance.

DESCRIPTION OF THE PREFERRED EMBODIMENT

Figures 1, 2, 3, 4:
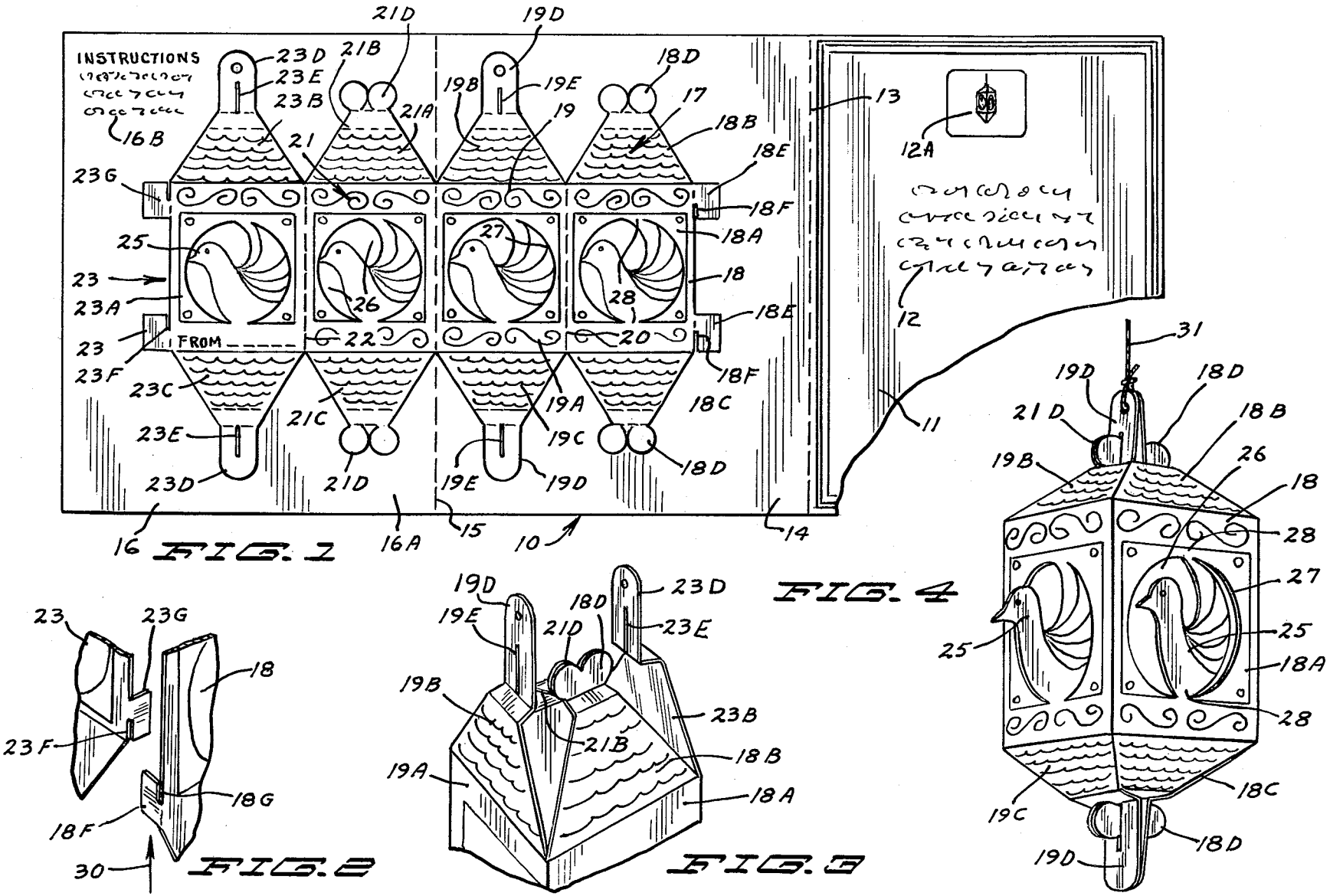
FIG. 1 is a flat layout of a greeting card embodying an ornament made according to the present invention.
FIG. 2 is a detailed view showing a step of erecting the ornament of the present invention.
FIG. 3 is a perspective view showing a further step in the erection of the ornament of the present invention.
FIG. 4 is a view of the ornament as it would appear when it is hanging from a string.

FIG. 1, a flat layout of a three panel greeting card is illustrated. This card is indicated generally by the numeral 10, and includes a front panel 11 on which a verse or written greeting 12 is written. Panel 11 is detachably joined along a perforated line 13 to a second card panel 14, which in turn is attached along a fold or score line 15 to a third card panel 16.

The third card panel 16 is folded down from the plane of the paper along the fold line 15, so that it would turn back against the backside of the panel 14, and then the cover panel can be folded along the perforated line 13 to close the card so that the front face 16A of the third panel 16 would be visible as soon as the front panel 13 of the card is opened. A view showing the folding of the card is provided in my co-pending application Ser. No. 685,820, filed May 12, 1976.

The second and third panels 14 and 16, as shown, are used for providing sheet stock for a four panel, three dimensional ornament indicated generally at 17. The card is made of suitable weight paper board stock. The ornament in this instance is a four section or four wall bird cage which would be generally rectangular in cross section at its midportions, and which has pyramidal upper and lower ends. The fold line 15 is used for a fold or score line along which one of the folds between two adjacent panels of the ornament will be made. The fold in this area is thus ready-made.

Instructions for forming or erecting the ornament are printed as indicated at 16B, so they also would be visible as soon as the front panel of the card 12 is opened. Further, an illustration 12A of the assembled ornament is included on the front face of the card so that the receiver or recipient would know immediately that an ornament is formable from the punch out on the interior of the card.

The punch out is made by sliting the outline of the ornament in a known manner, but leaving small attachment sections between the ornament and the main portions of the card panels at desired locations so that the ornament will not fall out of the panel.

The ornament 17 is formed into a first panel 18, which includes the midportion 18A, and upper and lower portions 18B and 18C, respectively. At the ends of the upper and lower portions there are part circular tabs arranged side by side, and illustrated at 18D. At the outer edge of the panel 18 there are a pair of lock tabs 18E that have partial slits about half-way up their length indicated at 18F. These lock tabs as will be explained are used for holding the three dimensional cage in its assembled form.

A second panel 19 also has a center portion 19A, end portions 19B and 19C, and in this instance, the end portions each have an assembly tab 19D therein, and each of the tabs have a vertically extending slit 19E. The tabs 19D extend outwardly from the panels 19B and 19C, respectively.

Panel 19 is joined to the panel 18 along a fold or score line 20 so that it can be folded along this junction line. It should be noted that the center portions only are joined along this fold line, and that the end portions 18B, 18C and 19B and 19C, respectively, are not joined together in the flat or unassembled form.

The fold line 15 forms the junction line between center portion of panel 19, and a center portion 21A of a panel 21 which also includes end panels 21B and 21C, respectively. The panels 21B and 21C have circular lock tabs 21D which correspond to the tabs 18D in their respective upper and lower panel portions of panel 18.

The center portion 21A of panel 21 is joined along a fold line or score line 22 to a fourth panel 23. The fourth panel 23 has a center portion 23A, upper and lower portions 23B and 23C, and end tabs 23D which correspond to the end tabs 19D. The end tabs 23D are attached to the respective panels 23B and 23C, and extend outwardly therefrom. Slit lines 23E are provided in these tabs 23D just as slit lines 19E are provided. The center portions of each of the panels are provided with a representation of a dove or bird indicated generally at 25. The bird in each of the panels is defined by a pair of punch out portions or slugs 26, which are shown in panel 21A, and by a curved slit line shown by line 27 in panel 19A. The bird remains attached to the center portions of each panel at the top and bottom as indicated at the points 28 in panel 18A. It is to be understood that the construction in each of the center birds is the same in each of the panels, but that the numbers are used on separate panels for sake of clarity.

When the ornament 17 has been punched out of panels 14 and 16 of the card, it should be noted that the slugs 26 which define the birds in the center portion of each of the ornament panels can also be punched out and the beak of the bird will be cut or slit loose from its adjacent panel as well. The slit line 27 extends on an arc around the tail of the bird so that the junction points or regions 28 are substantially diametrically across, and the bird body can be twisted with respect to the plane of the center portion of each of the respective ornament panels so that the head of the bird will extend out from the side wall plane and outwardly from the finished ornament.

Once the entire ornament (all four panels) has been punched out of the card, and the slugs 26 removed so that the birds can be twisted as described, the adjacent panels 18, 19, 20 and 21 are folded to make a rectilinear cross section box with the center panel portions. The panel 23 has tabs 23G adjacent its outer edge, as shown, and these tabs have upwardly facing slits 23F that partially sever the tab from the side of the panel. When the unit is folded to form a rectangle or square cross section, the edges of panels 18 and 23 will be adjacent as shown fragmentarily in FIG. 2. The edges that carry the tabs 18E and 23G respectively will be adjacent. The tabs 18E and 23G are bent at right angles to the respective panels to which they are attached, and then the panels are interlocked by slipping the tabs 23G on the inside of the panel 18, and the tabs 18E on the inside of the panel 23, and then moving the two sets of tabs together so that these slits 23F and 18F interlock. This movement is indicated by the arrow 30 in FIG. 2. Then the ornament will form a hollow box section as shown generally in FIGS. 3 and 4.

Before any further forming, the ornament will then be a tube. In the next step, the panel end portion 18B and 18C and 21B and 21C are bent together so that they will meet at the top and bottom of the ornament respectively. Referring to FIG. 3, the end portion 18B has been folded inwardly from the center portion 18A, so that the tabs 18D and 21D are touching. It should be noted that the panel end portions are joined to the center portions of each of the panels 18, 19, 21 and 23 along score lines so that the end portions can be folded. Also the tab members 18D and 21D are joined to their respective panel end portion along scored fold lines, to permit folding the tabs out of the plane of the main end portion 18B, 18C, 21B and 21C.

The ornament will then appear as it is in FIG. 3, and the panel end portion 19B can be folded along the score line where it joins the panel center portion 19A so that it tapers inwardly toward the sides of panels 18A and 23A.

The tab portion 19D can be bent out of the plane of the panel portion 19B, as the panel portion 19B is folded down against the edges of the panel portions 23B and 18B.

Then, one-half (one circular portion) of the contiguous lock tabs 18D and 23D can be inserted through the slit 19E to lock the panel end portion 19B in position and to hold the panel portions 18B and 23B together. Likewise, the panel portion 21B can be folded toward the portion of lock tabs 21D and 18D that are adjacent it, and the slit 23E can be slipped over these lock tabs and held in place. The lower end portion of the panels are formed in the same manner. The final assembled ornament is shown in FIG. 4, and it should be noted that if desired additional fold lines can be used to bring the tabs into shape. Such fold lines are shown and make a slightly flat top and bottom to the ornament as shown in FIG. 4.

In FIG. 4, it can be seen that all of the panels are locked into position and the tabs 18D and 21D are positioned along a common plane at the top and bottom of the ornament, and held in place by the slits 19E and 23E on the end tabs 19D and 23D.

The bird figures 25 as shown are bent out of the plane of the panels from which they are formed and held into the ornament by the attachment portions 28. As shown, small apertures are provided in the tabs 19D and 23D, on at least one end of the unit, and a cord 31 may be used for supporting the unit as a hanging ornament.

The front card panel 11 can be detached as stated and kept as a souvenir by tearing it along the perforated line 13, and the rest of the panels can be discarded after the ornament has been punched out. The unique three dimensional cage type ornament is therefore easily erected from the second and third panels of a three panel greeting card.

It should also be noted that space for the signature of the sender is provided on panel 21, which signature is visible as soon as the card is opened and will also be on the ornament. A separate signature space may also be provided on the front panel.

What is claimed is:

1. In a greeting card made of foldable stock material comprising a plurality of flat card panels folded relative to each other along at least one fold line, and having a punchout ornament carried thereon, the improvement comprising said ornament being formed of first, second, third and fourth ornament panels each foldably connected to the next adjacent ornament panel, with the outer edges of said first and fourth panels being unattached, and at least one of said fold lines between the ornament panels corresponding to the fold line between the card panels, each of said ornament panels comprising a center panel of generally rectilinear form, and separate generally triangular end portions foldably attached to each of said center panels at the opposite ends of the center panels and extending away from the respective center panels, said center panels being foldable relative to each other to form an open center three dimensional polygon, means to retain the normally free edges of said first and fourth center panels together to form a generally rectilinear tube from said four center panels having a central axis, the end portions of the respective center panels all being foldable toward the central axis to form a pyramidal shape at opposite ends of said three dimensional polygon formed by the center panels, the end portions of the first and third center panels including tab means at the outer ends thereof, said tab means being foldable relative to said end portions adjacent said central axis when the end portions are folded in toward said central axis to extend outwardly from the said end portions at the opposite ends of the ornament, and said tab means of the first and third end portions of the respective ends of the ornament being substantially continguous to each other when folded to pyramidal shape and the end portions of the respective second and fourth center panels including elongated tabs which extend outwardly from the ornament when the end portions of the second and fourth center panels are folded to pyramidal shape, said tabs on said second and fourth end portions including slits adapted to receive both of the tab means of the respective first and third end portions to hold the tab means at each of the opposite ends of said ornament contiguous and to hold the end portions in pyramidal shape and wherein at least one of said center portions has a partially punched out representation of an object, said representation being retained by only two narrow attachment bands to the respective center portion, said attachment bands forming pivot aligning members to permit twisting the representation out of the plane of the respective center portion.

2. The combination of claim 1 wherein said means to hold the free edges of the first and fourth ornament panels together comprises interlocking slitted tabs positioned toward the interior of the tubular polygon.

3. The combination of claim 1 wherein said card includes a greeting panel detachably secured to the rest of the card, said ornament being punched out of portions of the card other than the greeting panel.

* * * * *